US007559849B1

(12) United States Patent
Cuddie

(10) Patent No.: US 7,559,849 B1
(45) Date of Patent: Jul. 14, 2009

(54) BALL MARK REPAIR TOOL AND METHOD OF USE THEREOF

(76) Inventor: Gary James Cuddie, 102 Largo Dr., Vidalia, GA (US) 30474

( * ) Notice: Subject to any disclaimer, the term of this patent is extended or adjusted under 35 U.S.C. 154(b) by 1 day.

(21) Appl. No.: 12/070,774

(22) Filed: Feb. 21, 2008

(51) Int. Cl.
*A63B 57/00* (2006.01)

(52) U.S. Cl. ..... 473/286; 172/378

(58) Field of Classification Search ..... 473/286; 172/378

See application file for complete search history.

(56) References Cited

U.S. PATENT DOCUMENTS

| | | | | |
|---|---|---|---|---|
| 2,869,915 | A | 1/1959 | Good | |
| 3,771,794 | A | 11/1973 | Crockett | |
| 4,846,286 | A | 7/1989 | McNeely et al. | |
| 4,858,925 | A * | 8/1989 | DeStefano, Jr. | 473/285 |
| 4,957,293 | A * | 9/1990 | Byrd | 473/285 |
| 5,277,425 | A * | 1/1994 | Petriano, Sr. | 473/286 |
| 5,398,927 | A | 3/1995 | O'Sullivan | |
| D377,817 | S * | 2/1997 | Huber | D21/721 |
| 5,730,226 | A | 3/1998 | Kendall | |
| 5,782,443 | A * | 7/1998 | La Fontaine | 248/156 |
| 6,048,274 | A * | 4/2000 | Lesage | 473/286 |
| 6,062,992 | A | 5/2000 | Hoyt et al. | |
| 6,095,935 | A * | 8/2000 | Gooselaw et al. | 473/408 |
| 6,244,356 | B1 * | 6/2001 | Luna | 172/381 |
| 6,267,269 | B1 | 7/2001 | Kates | |
| 6,585,606 | B2 * | 7/2003 | Penrose | 473/284 |
| 6,749,522 | B1 * | 6/2004 | Aikman | 473/286 |
| 6,899,635 | B2 * | 5/2005 | Nadratowski et al. | 473/285 |
| 2003/0013540 | A1 * | 1/2003 | Penrose | 473/284 |
| 2003/0104875 | A1 * | 6/2003 | Markwood | 473/285 |
| 2004/0166955 | A1 * | 8/2004 | Nadratowski et al. | 473/286 |
| 2004/0219997 | A1 | 11/2004 | Champion | |
| 2007/0060412 | A1 * | 3/2007 | Penton | 473/285 |
| 2007/0213142 | A1 * | 9/2007 | Derr | 473/286 |

FOREIGN PATENT DOCUMENTS

| | | | |
|---|---|---|---|
| GB | 2391818 | A1 | 2/2004 |

OTHER PUBLICATIONS

Fix-Master Divot Tool, Starting Time [online], [retrieved on Jun. 16, 2008], Retrieved from the internet: <URL: http://www.startingtimegolf.com/divot.php>.

Starting Time Fix-Master Divot Tool, PGA Your Partners Magazine, Nov./Dec. 2007, 94, PGA Tour Partners, U.S.A.

* cited by examiner

*Primary Examiner*—Stephen L. Blau
(74) *Attorney, Agent, or Firm*—Kaplan Ward & Patel, LLC; Sandra M. Sovinski

(57) ABSTRACT

A ball mark repair tool and method of use thereof, comprising, in general, a turf gripping element having a plurality of tapered tines and means for releasably and loosely affixing the turf-gripping element to the grip end of a golf club shaft, wherein positional placement and application of a force outside the peripheral edge of a ball mark functions to properly repair a ball mark aiding in maintaining a smooth and level putting surface.

21 Claims, 6 Drawing Sheets

BALL MARK REPAIR TOOL AND METHOD OF USE THEREOF

TECHNICAL FIELD

The present invention relates generally to a tool for maintaining golf-course greens, and more specifically to tool for quickly and effectively repairing indentations, ball marks and mounds, called golf ball marks, such as those found on a putting surface of golf-course greens due to impact from golf balls.

BACKGROUND

In the game of golf, it is common for the golf ball to land on the putting surface, called the "green", with substantial force; sufficient to leave an indentation or ball mark. It is proper golf etiquette for players to repair any indentation made on the putting surface by the landing of their golf ball, but many either fail to do so or compound the problem through use of use of improper tools and/or techniques. Therefore, it is necessary for greens-keepers and their staff to professionally repair every green at regular intervals, such as once every day, because one of the most frustrating experiences in the game of golf is to have a putt diverted off line by a ball mark which has either been left un-repaired or improperly repaired. As a further complication, if the ball marks are neglected for more than 24 hours or repaired improperly, the damaged grass will die, leaving an unsightly brown spot and an uneven putting surface.

Specifically, ball marks occur as a result of a player attempting to land his or her ball on the green during play. Ball marks are basically indentations in the surface of a golf-course green putting area resulting from the ball landing on the golf-course green putting area with sufficient force to compress the turf, soil, and/or drainage material proximate the impact location. Additionally, especially associated with longer shots, a raised mound of turf, soil, and/or drainage material may be created by lateral impact forces.

There exist a number of conventional devices for fixing ball marks, including elaborate tools with radially extending blades pivotally mounted to a center hub and simultaneously activated through a linkage mechanism or tools with plurality of radially inwardly moving fingers actuated by a camming mechanism upon pressing or pushing. In operation, actuating blade tips and/or fingers for movement radially inwardly tend to dislodge the turf and soil from around the region of the ball mark, into the region of the ball mark, so as to level off the indentation in the golf green. Such devices tend to displace, cut or tear through the turf and soil repositioning a plurality of small areas of turf and soil inwardly toward the ball mark center. Moreover, these devices are unable to reposition the raised mound since their blade tips and/or fingertips uniformly reposition small areas of turf and soil around the edge of the ball mark.

Simpler hand-operated tools such as forks, tines and pronged devices or levers, including those rigidly attached by an expandable fastener to an interior surface of a handle end of a shaft of a golf club, have been utilized. In use, the prongs of the tool are inserted into the ground adjacent to a ball mark and at an angle such that the tips of the prongs are directed toward the center and beneath the ball mark. After inserted, the tool is tilted or pushed inwardly, rotating about the tips, to displace the compressed turf and soil toward the center of the indentation, thus filling the ball mark or indention. This process must be frequently repeated several times around the periphery of the indentation to adequately repair the mark and restore the location of the mark to its original condition. However, these simpler tools are rigid and problematically enable the operator to incorrectly pry the ball mark up by applying an upward force under the center of the ball mark by pressing down on a handle or shaft of the device.

Furthermore, a golfer or an attendant repairing indentations in a golf-course operating a hand tool such as a fork device is required to bend over or kneel down to the ground to repair a ball mark. Repeating this process continuously throughout the day is very tiring and the continuous action of bending to the ground is hard on the back and knees.

In view of the present invention, the background ball repair tools are deficient in many ways. Specifically, hand-operated tools are often misused, aggravating the damage to a putting surface and leading to damage to the grass in the location where repair is attempted. For example, the grass can die if the hand tool is inserted and the tip or prong is pried upward. From an external appearance the area may look repaired as the turf is level, but nonetheless the grass roots are often damaged or displaced from the soil and die, forcing the area to be re-sodded or reseeded.

In addition, sophisticated ball mark repair tools with pivoting blades and fingers with linkage mechanisms, springs and camming mechanism are heavy, complex and require maintenance, repair and eventually replacement during their work life, thereby adding to the cost and inconvenience of maintaining the golf-course.

Therefore, it is readily apparent that there is a recognizable need for a ball mark repair tool and method of use thereof that functions to enable a golfer to repair a ball mark indentation without bending over or squatting while performing the repair task and wherein the repair tool has no moving parts and further prevents or reduces misuse of the tool, such as when used by the golfer as a fulcrum to pry or apply an upward force on the underside of the ball mark and, thereby such ball mark repair tool is easy to use, inexpensive to manufacture and yet functions in a proper manner to quickly and correctly repair ball marks.

BRIEF SUMMARY OF THE INVENTION

Briefly described in a preferred embodiment, the present invention overcomes the above-mentioned disadvantages and meets the recognized need for such a device by providing a ball mark repair tool and method of use thereof, comprising, in general, a turf gripping element having a plurality of tapered tines and means for releasably and loosely affixing the turf gripping element to the grip end of a golf club shaft, wherein positional placement and application of a force outside the peripheral edge of a ball mark functions to properly repair a ball mark aiding in maintaining a smooth and level putting surface.

According to its major aspects and broadly stated, the present invention in its preferred form is a ball mark repair tool and method of use thereof, comprising a dome-shaped base with tines extending orthogonal from a flat side of the base and a contoured prong extending from the dome-shaped side of the base for flexibly affixing by penetrating a vent hole in a golf club grip.

More specifically, the preferred embodiment of the present invention is a ball mark repair tool and method of use thereof, comprising a dome-shaped base having a plurality tines extending orthogonally from a flat side of the base, wherein such tines taper from the base to the tip and have a rounded tip, and a contoured prong extending from the dome-shaped surface of the base for releasable insertion into the vent hole of a golf club grip. Preferably, the dome-shaped base, tapered tines and the contoured prong loosely affixed to the rubber grip of the shaft of a golf club function to prevent or reduce misuse of the tool by the golfer, such as use thereof as a fulcrum to pry or apply an upward force on the underside of the ball mark. Additionally, the tines are tapered to enable insertion and removal with out lifting the turf or soil surrounding the ball mark, where by damage to the grass roots caused by displacement thereof from the soil. In operation, a golfer or greens keeper grasps the golf club by the head, holding it upside down with the ball mark repair tool releasably inserted into the vent hole of a golf club grip, and performing a jabbing motion to insert the tines into the green surface proximate the peripheral edge of a ball mark to displace the compressed turf toward the center of the indentation, thus filling the ball mark or indention.

Accordingly, a feature and advantage of the present invention is its ability to provide a tool for repairing divots, ball marks, and other indentations in the turf surface of a golf-course green from a standing position without bending over.

Another feature and advantage of the present invention is its ability to provide a ball mark repair tool which may be simply and economically constructed and wherein the tool may be manipulated by means of the club shaft by releasable attachment to the hand grip portion of the shaft.

Still another feature and advantage of the present invention is its ability to provide a repair tool for golf ball marks or indentations created on the golf-course green and more specifically the repair of a compression mark or indentation made by the force of a golf ball landing on a golf green by displacing surrounding and compacted green into the cavity or indentations.

Yet another feature and advantage of the present invention is its ability to provide a dome-shaped base, short tapered tines and a contoured prong loosely affixed to the rubber grip that prevents the tool from being used as a fulcrum to pry or apply an upward force on the underside of the ball mark or to insert into the ball mark and pull the compressed turf upward.

Yet another feature and advantage of the present invention is its ability to provide a ball mark repair tool that does not have any moving parts and provides a means for movement of an interconnected patch of turf and/or soil into the region of the ball mark and/or damaged area of golf-course green.

Yet another feature and advantage of the present invention is its ability to use the existing vent hole of a golf club grip without alteration of the golf club or grip or damage to or alteration of the grip by enlarging the vent hole or cutting open the grip to insert an expandable fastener for rigidly engaging the interior surface of the shaft.

Yet another feature and advantage of the present invention is its ability to provide a ball mark repair tool requiring only application of a downward force on a handle to move downwardly extending prongs into the surface of the turf such that a patch of turf and/or soil may be moved into the region of the ball mark and/or damaged area of a golf-course green.

Yet another feature and advantage of the present invention is its ability to provide a convenient and portable ball mark repair tool for repairing irregularities in the turf which may potentially affect the rolling of a golf ball directed toward the hole if left unrepaired.

Yet another feature and advantage of the present invention is its ability to provide a ball mark repair tool that can be readily used by untrained individuals to efficiently and properly remove ball marks on the golf-course green.

Yet another feature and advantage of the present invention is its ability to provide a ball mark repair tool which has simple construction and is highly durable and reliable in use.

Yet another feature and advantage of the present invention is its ability to provide a turf repair system which is compact, lightweight and easy to store and transport.

Yet another feature and advantage of the present invention is its ability to provide a turf repair system that allows the green to heal quickly.

Yet another feature and advantage of the present invention is its ability to provide a turf repair system having tine dimensions and configurations that minimize root damage.

Yet another feature and advantage of the present invention is that its dimensions and configuration most conveniently allow the ball mark repair tool to remain attached to the club continually if used in conjunction with a readily available golf tube placed in the golf bag to receive the tool/club combination.

Yet another feature and advantage of the present invention is its ability to provide a ball mark repair tool which is inexpensive, functional, and enables more golfers to repair ball marks correctly, resulting in better conditions of greens for all golfers.

These and other features and advantages of the present invention will become more apparent to those ordinarily skilled in the art from the following description and claims when read in light of the accompanying drawings.

BRIEF DESCRIPTION OF THE DRAWINGS

The present invention will be better understood by reading the Detailed Description of the Preferred and Selected Alternative Embodiments with reference to the accompanying drawing figures, in which like reference numerals denote similar structure and refer to like elements throughout, and in which.

DETAILED DESCRIPTION OF THE PREFERRED EMBODIMENTS

In describing the preferred and selected alternative embodiments of the present invention, as illustrated in FIGS. 1-5, specific terminology is employed for the sake of clarity. The invention is not, however, intended to be limited to the specific terminology so selected, and it is to be understood that each specific element includes all technical equivalents that operate in a similar manner to accomplish a similar function.

Figure 1:
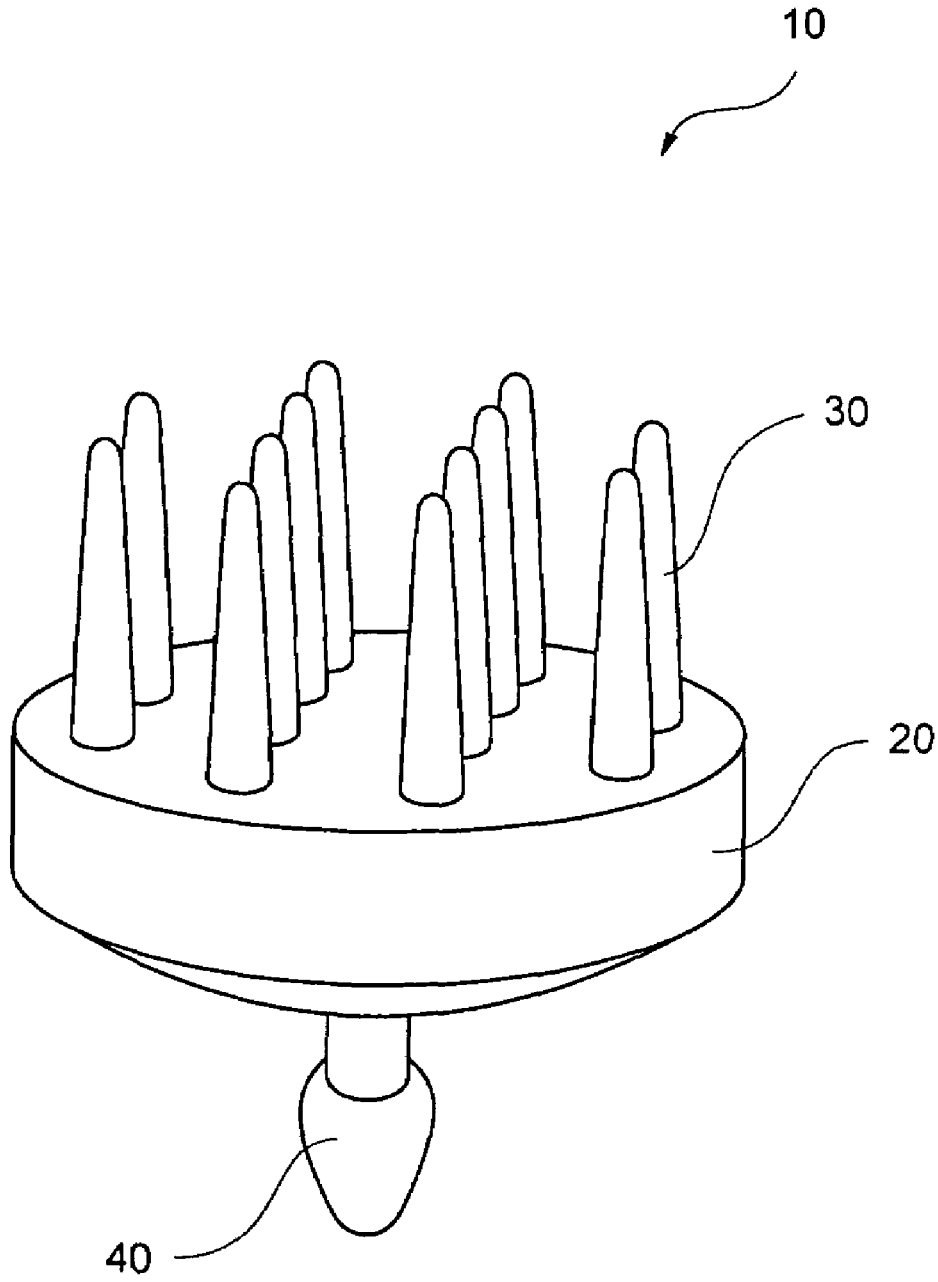
FIG. 1 is a perspective view of a ball mark repair tool according to a preferred embodiment of the present invention.

Referring now to FIG. 1, by way of example, and not limitation, there is illustrated a perspective view of ball mark repair tool 10 in accordance with a preferred embodiment of the present invention. Preferably, ball mark repair tool 10 comprises base 20, tines 30, and prong 40. Ball mark repair tool 10 is preferably formed from a suitable durable material, such as plastic, nylon, metal, stainless steel, aluminum, or the like, capable of providing structure to ball mark repair tool 10 for engaging the turf, soil and/or ground without damage thereto. Preferably, the material includes other suitable characteristics, such as malleability, moldability, durability, water-resistance, light weight, ease of workability, or other beneficial characteristic understood by one ordinarily skilled in the art.

Figure 2A:
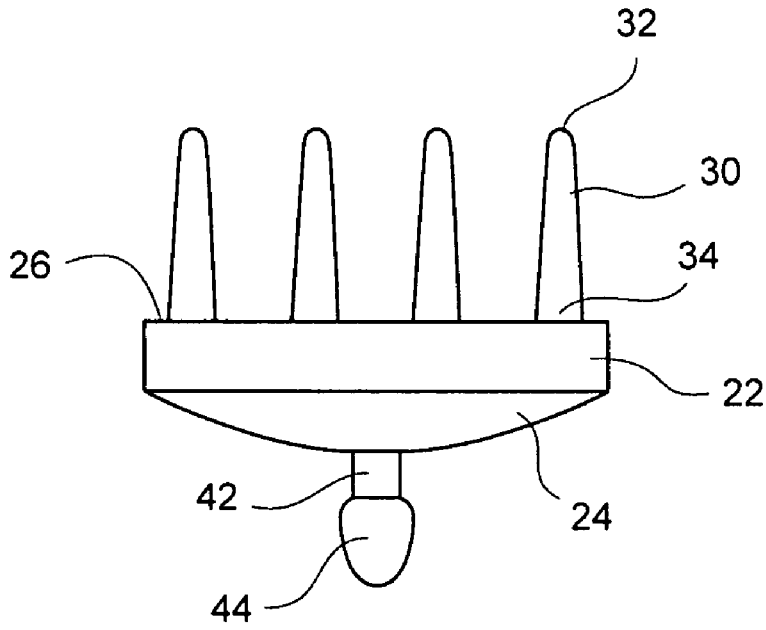
FIG. 2A is a side view of a ball mark repair tool according to a preferred embodiment of the present invention.
Figure 2B:
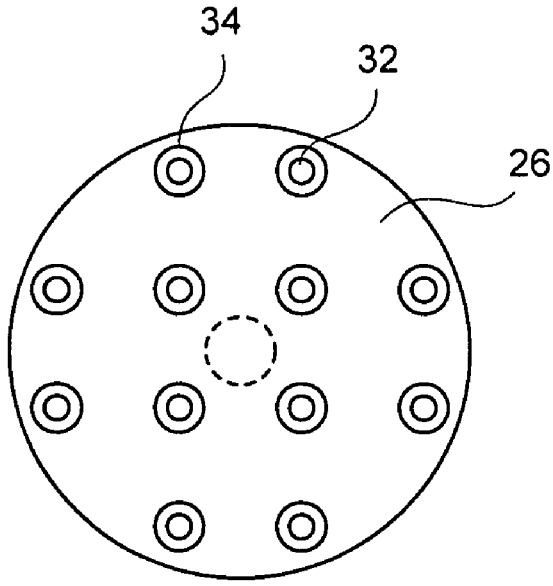
FIG. 2B is a top view of a ball mark repair tool according to a preferred embodiment of the present invention.

Referring now to FIGS. 2A and 2B, base 20 preferably comprises circular member 22 having semi-spherical or dome-shaped top 24 on one side and flat surface 26 on the opposite side. Circular member 22 preferably measures approximately one and one-quarter (1.25) inch in diameter, enabling ball mark repair tool 10 to be inserted in a standard golf tube while in place and attached to golf club G for storage with the golf tube providing protection for a golf bag. Flat surface 26 preferably has a plurality of tines 30 integrally connected to and extending upwardly from flat surface 26. Preferably twelve (12) tines 30 are included substantially aligned parallel with one another and extending substantially orthogonally from flat surface 26.

Preferably each of tines 30 is approximately five-eighths (0.625) inch in length measured from tine base 34 at their connection to flat surface 26 of base 20 to rounded tip 32. Further, tines 30 are preferably tapered measuring approximately one-sixteenth (0.0625) inch in diameter at tine tip 32 and tapering uniformly to approximately three-thirty-second (0.09375) inch in diameter at tine base 34, where tine 30 connects to flat surface 26 of base 20. Tines 30 preferably taper toward the distal end or tip for allowing easy penetration into the turf, soil and/or ground. Still further, tines 30 preferably are configured in a grid formation, evenly spaced, having a center-to-center spacing therebetween measuring approximately five-sixteenth (0.3125) inch. Preferably, the combined width of tines 30 is smaller than the surface area of flat surface 26. Preferably, tine tips 32 are preferably blunted, pointed or rounded for preventing damage to the turf during use. It can also be appreciated that a single tine or multiple tines 30 may be attached to flat surface 26 of base 20 depending upon the turf, and/or soil conditions encountered.

It is contemplated herein that tines 30 may comprise alternate dimensions, numbers and configurations to minimize root damage while efficiently loosening the compaction caused by the golf ball striking the green. Moreover, tines 30 may comprise varying tapered diameters from flat surface 26 to tine tips 32. Moreover, it is contemplated herein that flat surface 26 may comprise alternate dimensions and configurations to produce a leveled green to minimize the deflection of the next golf ball to roll over the repaired area.

It is contemplated herein that dome-shaped top 24 may comprise alternate dimensions, shape and configurations to enable angular flex between ball mark repair tool 10 and golf club G.

Prong 40 preferably protrudes from dome-shaped top 24 and comprises stem 42 and egg-shaped tip 44. Stem 42 preferably is configured as a cylinder measuring approximately one-quarter (0.25) inch in length and one-eighth (0.125) inch in diameter. Egg-shaped tip 44 preferably is configured as an egg measuring approximately one-quarter (0.25) inch in length and approximately five-thirty-seconds (0.15625) inch at its maximum diameter.

Although the foregoing describes the preferred configurations, shapes, dimensions and materials selections for the manufacture of ball mark repair tool 10 comprising, base 20, tines 30, and prong 40, it should be recognized that base 20, tines 30, and prong 40, circular member 22, dome-shaped top 24, tine tip 32, tine base 34 stem 42 and egg-shaped tip 44 may comprise alternate configurations, shapes, dimensions and materials to accommodate particular golf clubs, turf, and/or soil conditions encountered.

Figure 3:
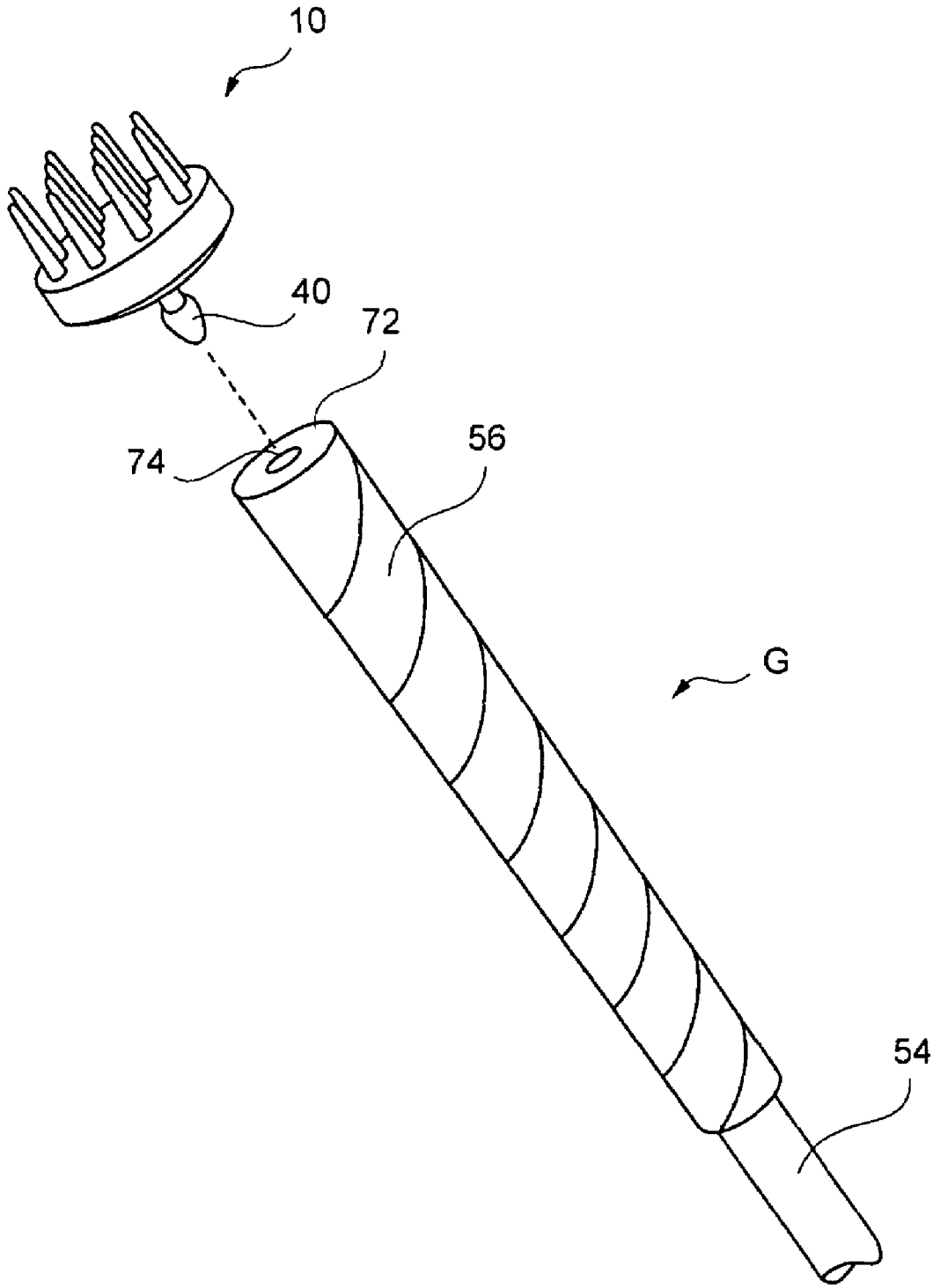
FIG. 3 is a perspective view illustrating the attachment of the ball mark repair tool to the hand grip of a golf club according to a preferred embodiment of the present invention.

Referring to FIG. 3, ball mark repair tool 10 is preferably releasably and flexibly affixed to golf club G. Golf club G comprises shaft 54, iron or head 52 (shown in FIG. 4) attached to a first end 62 of shaft 54 and attached to a second end 64 a length of gripping material 56 positioned about shaft 54. Shaft 54 is an elongated structure with a longitudinal axis and may be constructed of any suitable material such as graphite or stainless steel, which materials are well known. In addition, shaft 54 may taper from second end 64 towards first end 62, as shown in FIG. 3, or the diameter of shaft 54 may be substantially consistent. Gripping material 56 is preferably manufactured from a rubber material or other similar stretchable material, or single slip-on piece, fabric or tape with a stretchy material woven into it so that it can fit tightly around shaft 54.

As another important advantage of this invention, ball mark repair tool 10 is releasably and flexibly affixed to golf club G without alteration of club G and without removal or destruction of gripping material 56. In this regard, gripping material 56 is preferably made of an elastic rubber and commonly wrapped around second end 64 of shaft 54 of most golf clubs G. Preferably vent hole 74 measuring approximately one-eighth (0.125) or less inch in diameter is formed through top portion 72 (butt end) of gripping material 56 to communicate with the hollow interior of shaft 54 of golf club G.

Figure 4:
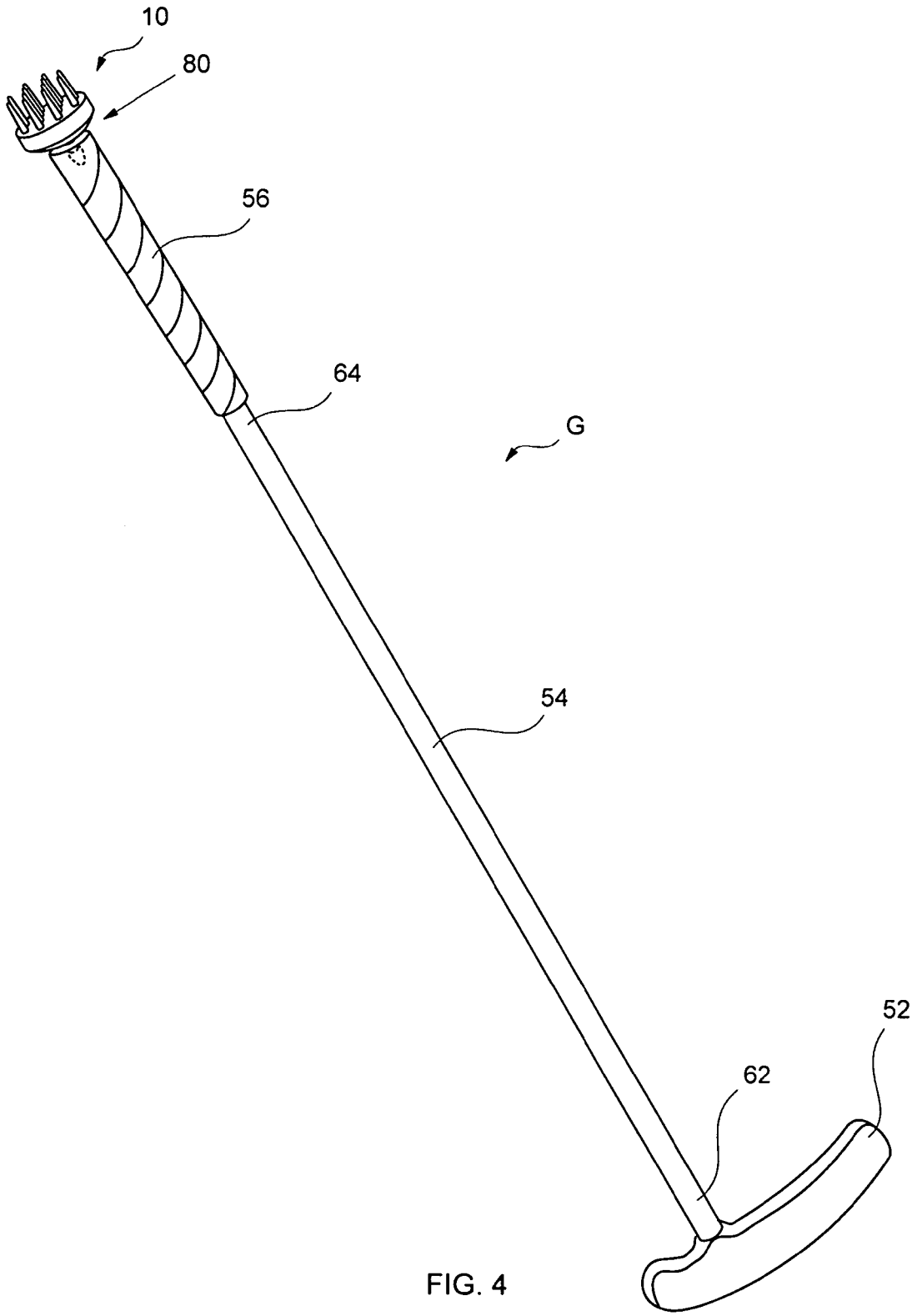
FIG. 4 shows a golf club having a ball mark repair tool attached thereto according to a preferred embodiment of the present invention.

When it is desirable to install ball mark repair tool 10 on golf club G, gripping material 56 of golf club G preferably is held in one hand or a golfer and ball mark repair tool 10 is held in the other hand, wherein prong 40 is axially aligned with vent hole 74. Preferably egg-shaped tip 44 of prong 40 is inserted through vent hole 74, wherein the elastic properties of gripping material 56 allow the larger-sized egg-shaped tip 44 to penetrate vent hole 74 and thereafter releasably and flexibly affix ball mark repair tool 10 to golf club G, as shown in FIG. 4. That is, egg-shaped tip 44 spreads vent hole 74 open, penetrates vent hole 74, and enables gripping material 56 to grip stem 42 of prong 40 so as to releasably secure ball mark repair tool 10 to golf club G without destroying vent hole 74 or damaging gripping material 56 through which vent hole 74 is formed.

When it is desirable to remove ball mark repair tool 10, gripping material 56 of golf club G is preferably held in one hand by a golfer and ball mark repair tool 10 is held in the other hand, wherein the golfer gently pulls ball mark repair tool 10 apart from golf club G. Preferably, egg-shaped tip 44 of prong 40 is removed through vent hole 74, wherein the elastic properties of gripping material 56 allow the larger sized egg-shaped tip 44 to be pulled through vent hole 74 and thereafter a separation of ball mark repair tool 10 from golf club G occurs, as shown in FIG. 3. That is, egg-shaped tip 44 spreads vent hole 74 open, and slides out of vent hole 74, free from gripping material 56 so as to return golf club G to a golf club for use in the game of golf. As another important advantage of this invention, the ball mark repair tool 10 is releasably affixed to golf club G preferably enabling quick separation of ball mark repair tool 10 from golf club G so that golf club G may be returned to a golf bag without tines 30 tearing, gouging, puncturing or marring such golf bag.

Although in FIG. 4 ball mark repair tool 10 is shown carried at the end of a putter, it is to be understood that ball mark repair tool 10 can be attached to any other golf club G to enable a golfer to quickly and easily repair ball marks on a putting green of a golf course that are caused by a golf ball striking the surface of a green while playing the game of golf.

With ball mark repair tool 10 releasably and flexibly affixed to golf club G (creating a flexible joint 82 therebetween) in the manner described above, and shown in FIG. 4, tines 30 will project outwardly from the end of the shaft opposite head 52.

Figure 5A:
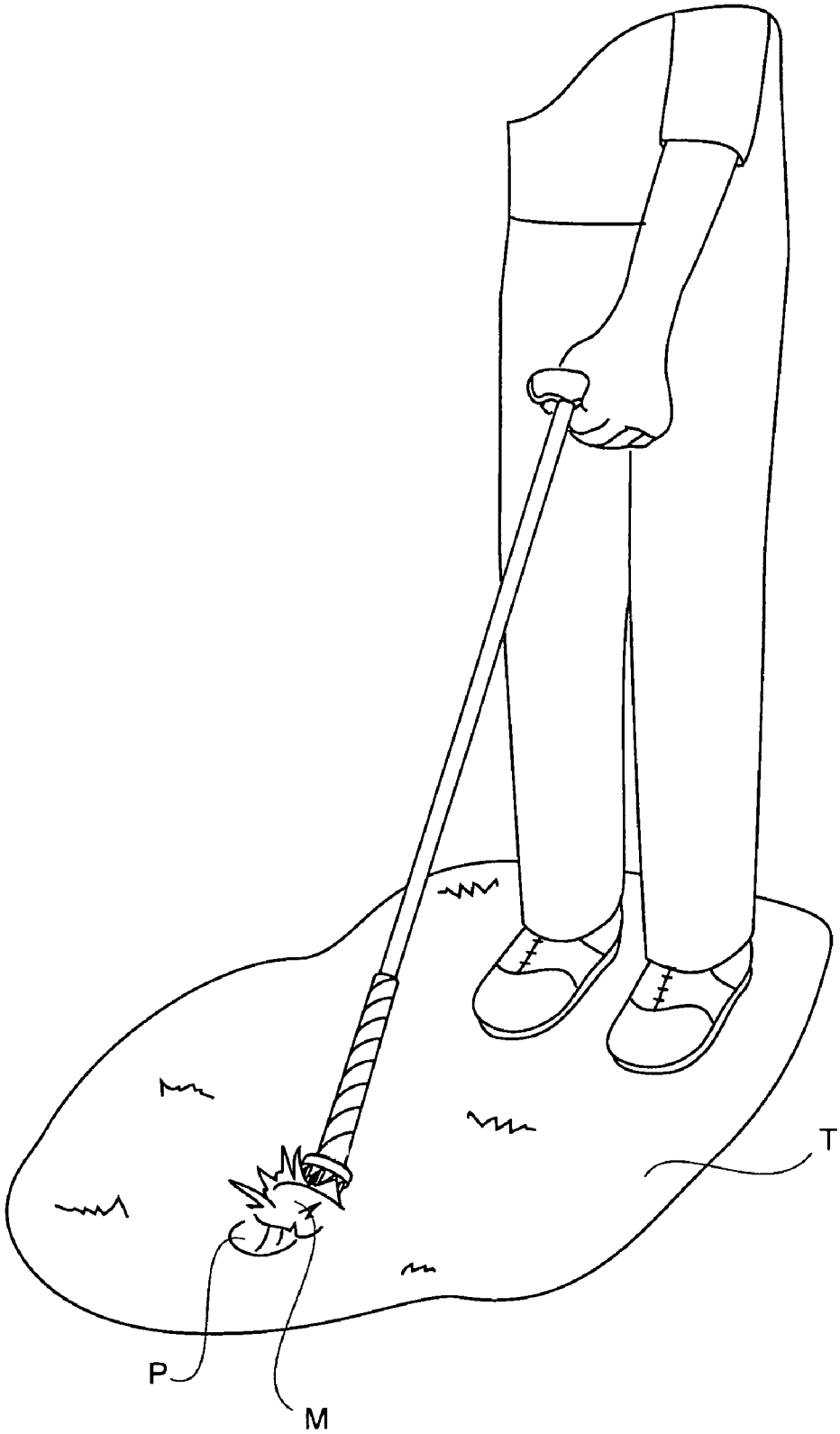
FIGS. 5A, 5B and 5C show a ball mark repair tool at the end of a golf club shaft being used to repair a ball mark on a golf-course green caused by impact of a golf ball.
Figure 5B:
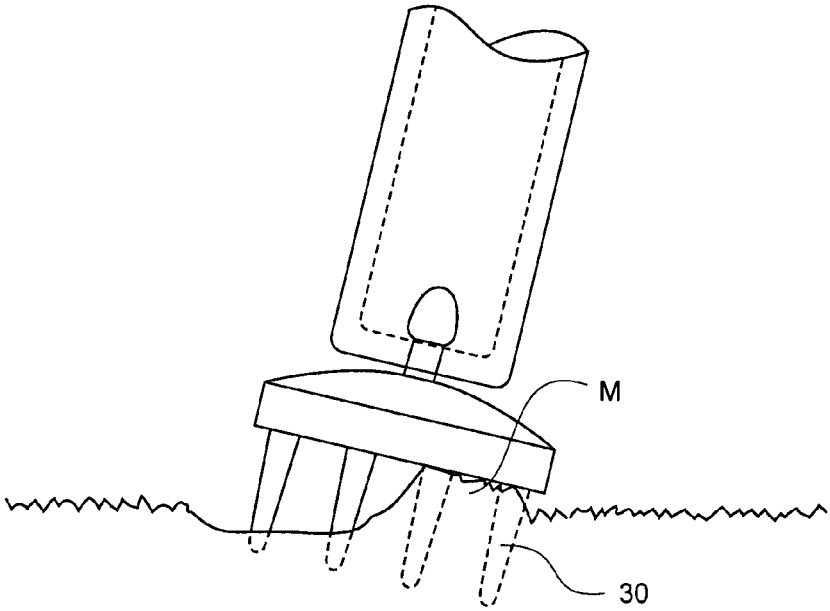
Figure 5C:
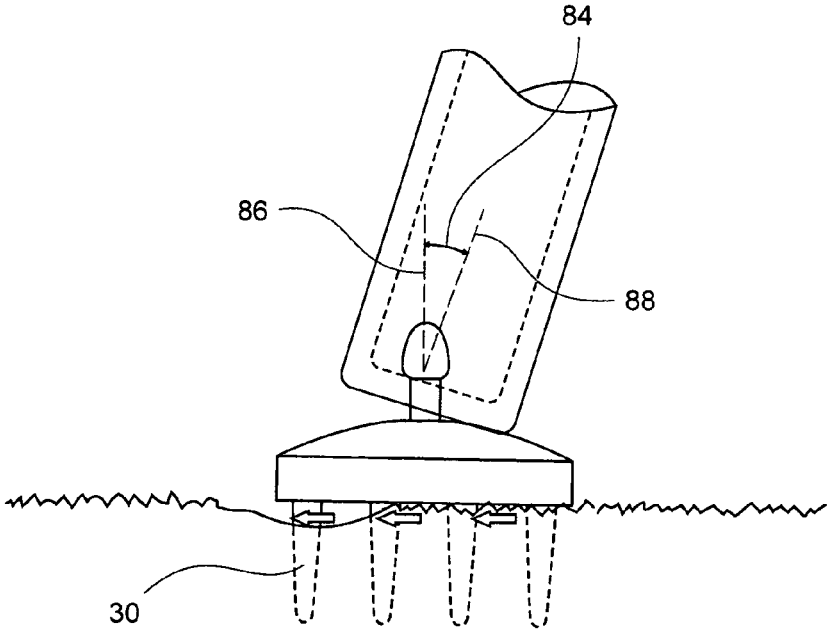

Referring to FIGS. 5A, 5B and 5C, when a golfer wishes to repair a ball mark on the putting green caused by the impact of golf ball, the golfer simply turns golf club G with its installed ball mark repair tool 10 upside down, grasps head 52 of golf club G (or shaft) and, without having to kneel down, pushes tines 30 of ball mark repair tool 10 into an area of the putting green in need of repair. By virtue of the flexible attachment between ball mark repair tool 10 and golf club G provided by gripping material 56 and dome-shaped top 24, ball mark repair tool 10 is able to self-align or adapt to the contours of the periphery of ball mark P and ball mark mound M. FIG. 5C preferably shows angle 84 as the difference between the center axis 86 of golf club G and the center axis 88 of ball mark repair tool 10, wherein contoured prong 40, loosely affixed to the rubber gripping material 56 of shaft 54 enables flexible joint 82 between golf club G and ball mark repair tool 10. By holding golf club G at less than 90 degrees to turf T (preferably twenty degrees off vertical) and applying a series of jabbing forces to head 52, such forces are applied to the shaft 54 and transmitted to flat surface 26 and tines 30. Tines 30 preferably engage ball mark mound M of turf T, and upon insertion of tines 30 into ball mark mound M contact occurs between flat surface 26 and ball mark mound M or turf T resulting a pivot action in flexible joint 82 between golf club G and ball mark repair tool 10. Upon applying an additional force to head 52 flat surface 26 flatens and repositions ball mark mound M toward the center of the indentation of ball mark P, whereby such force returns the green to a level, smooth grass surface in order to encourage the healing of the ball impact area.

Moreover, during use flat surface 26 preferably engages turf T and self-aligns flat surface 26 of ball mark repair tool 10 with the contours of the periphery of ball mark P and ball mark mound M as shown in FIGS. 5B and 5C via the flexible attachment between ball mark repair tool 10 and golf club G provided by gripping material 56 and dome-shaped top 24. Moreover, flat surface 26 preferably serves to prevent excess penetration into turf T and to act as a push blade in preferred alignment to transfer the force applied to shaft 54 of golf club G to turf T in an effort to move displaced turf T, such as ball mark mound M toward the center of the indentation of ball mark P, thus repairing ball mark P and its indentation producing a level surface minimizing any deflection of the next ball to roll over the repaired ball mark P.

Thus, it may be appreciated that the golfer need only use a single hand to manipulate tines 30 of ball mark repair tool 10 to facilitate ball mark repair by leveling the impact area with the surrounding grass. As a result of jabbing the grassy surface with tines 30, small holes will be formed to establish air channels for promoting a faster healing of the ball mark P. Once the repair is completed, ball mark repair tool 10 may be removed, wherein the golfer can then use head 52 of golf club G to tap down the repaired area to be restored to its original smooth playing surface.

As another important advantage of this invention, dome-shaped top 24, tapered tines 30 and contoured prong 40 loosely affixed to the rubber gripping material 56 of shaft 56 of a golf club G preferably functions to prevent or disable ball mark repair tool 10 from being used by the golfer as a fulcrum to pry or apply an upward force on the underside of ball mark P resulting in an air pocket under the surface of turf T. Moreover, the absence of a handle on tool 10 effectively prevents a prying action during use, which prying action is the primary cause of turf damage. Additionally, tines 30 are tapered to enable insertion and removal without lifting soil or turf T surrounding ball mark B, wherein the grass roots are often damaged or displaced from the soil and die. Moreover, preferably tines 30, with their shape and size, quickly aerate and loosen the compacted turf T caused by the ball impact without damaging the grass roots, thus allowing subsequent watering to wick down into turf T and stimulate turf growth.

In operation, a golfer or greens keeper grasps golf club G by head 52, holding it upside down with the ball mark repair tool 10 releasably inserted into vent hole 74 of a standard golf club gripping material 56, and applying a jabbing motion into turf T outside the peripheral edge of a ball mark B to displace the compressed turf T toward the center of the indentation, thus filling the ball mark B or indention. After inserting tines 30 which assist in holding turf T together, flat surface 26 preferably is pushed inwardly, to displace the compressed soil, ball mark mound M, and turf T toward the center of the indentation, thus filling the ball mark B or indention. This process must be repeated several times around the periphery of the indentation to fill ball mark B and restore the spot to its original condition.

The foregoing description and drawings comprise illustrative embodiments of the present invention. Having thus described exemplary embodiments of the present invention, it should be noted by those ordinarily skilled in the art that the within disclosures are exemplary only, and that various other alternatives, adaptations, and modifications may be made within the scope of the present invention. Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A ball mark repair tool to be inserted in a vent hole of the grip at an end of the shaft of a golf club, said ball mark repair tool comprising:

a base, said base having a central member with a dome-shaped top on one end of said central member and a flat surface on the opposite end of said central member;

a prong protruding from said dome-shaped top, said prong having a stem and an egg shaped tip for insertion into the vent hole of the grip at the end of the shaft of a golf club; and at least one tine integrally connected to and extending from said flat surface to a distal tip of said at least one tine.

2. The ball mark repair tool of claim 1, wherein said at least one tine projects from said flat surface perpendicular to the axis of said flat surface.

3. The ball mark repair tool of claim 1, wherein said at least one tine are configured in a grid formation and evenly spaced therebetween.

4. The ball mark repair tool of claim 1, wherein said at least one tine comprise shared tapering diameters from said flat surface to said distal tip.

5. The ball mark repair tool of claim 1, wherein at least one tine comprises varying tapered diameters from said flat surface to said distal tip.

6. The ball mark repair tool of claim 1, wherein at least one tine comprises varying and shared tapering diameters from said flat surface to said distal tip.

7. The ball mark repair tool of claim 1, wherein said distal tip is rounded.

8. The ball mark repair tool of claim 1, wherein said distal tip is pointed.

9. The ball mark repair tool of claim 1, wherein said tool is manufactured from a material selected from the group consisting of plastic, nylon, metal, stainless steel, aluminum, ceramics and combinations thereof.

10. The ball mark repair tool of claim 1, wherein said dome-shaped top, said prong protruding from said dome-shaped top, and said vent hole of the grip form a flexible joint, wherein said joint enables said flat surface of said ball mark repair tool to adapt to the contours of the periphery of the ball mark.

11. A ball mark repair system comprising:

a golf club including a shaft having a hollow interior, said golf club having a ball striking head located at a first end of the shaft, a grip surrounding a second end of the shaft, and a vent hole formed through said grip to communicate with hollow interior thereof; and a ball mark repair tool operable with said vent hole of said grip without having to alter said grip, said ball mark repair tool comprising:

a base, said base having a central member with a dome shaped top on one end of said central member and a flat surface on the opposite end of said central member;

a prong protruding from said dome shaped top, said prong having a stem and egg shaped tip; and a plurality of tines connected to and extending from said flat surface, said tines tapering from said flat surface to a distal rounded tip of said tines.

12. The ball mark repair tool of claim 11, wherein said plurality of tines projects from said flat surface in generally perpendicular to the axis of said flat surface.

13. The ball mark repair tool of claim 11, wherein said plurality of tines is configured in a grid formation and evenly spaced therebetween.

14. The ball mark repair tool of claim 11, wherein said plurality of tines comprises shared tapering diameters from said flat surface to said distal tip.

15. The ball mark repair tool of claim 11, wherein said plurality of tines comprise varying tapered diameters from said flat surface to said distal tip.

16. The ball mark repair tool of claim 11, wherein said plurality of tines comprises varying and shared tapering diameters from said flat surface to said distal tip.

17. The ball mark repair tool of claim 11, wherein said distal tip is rounded.

18. The ball mark repair tool of claim 11, wherein said distal tip is pointed.

19. The ball mark repair tool of claim 11, wherein said tool is manufactured from a material selected from the group consisting of plastic, nylon, metal, stainless steel, aluminum, ceramics and combinations thereof.

20. The ball mark repair tool of claim 11, wherein said dome shaped top, said prong protruding from said dome shaped top, and said vent hole of the grip form a flexible joint, wherein said joint enables said flat surface of said ball mark repair tool to adapt to the contours of the periphery of the ball mark.

21. A method for repairing a ball mark comprising:

obtaining a golf club including a shaft having a hollow interior, said golf club having a ball striking head located at one end of the shaft, a grip surrounding the opposite end of the shaft, and a vent hole formed through said grip of said shaft to communicate with hollow interior thereof; and a ball mark repair tool releasably inserted into said vent hole of said grip at the opposite end of said shaft without having to alter said grip, said ball mark repair tool comprising:

a base, said base having a central member with a dome-shaped top on one end of said central member and a flat surface on the opposite end of said central member;

a prong protruding from said dome shaped top, said prong having a stem and an egg shaped tip; and at least one tine connected to and extending from said flat surface, said tines tapering from said flat surface to a distal rounded tip;

holding, in a single hand while standing, said ball striking head of said golf club;

applying a jabbing motion to said golf club having said ball mark repair tool flexibly affixed thereto, such that said at least one tine penetrates the turf surrounding the ball mark, and wherein said flat surface displaces the compressed turf toward the center of the ball mark, thus, filling the ball mark.

* * * * *